US008746229B2

(12) United States Patent
Lacche

(10) Patent No.: US 8,746,229 B2
(45) Date of Patent: Jun. 10, 2014

(54) GAS BURNER SYSTEM FOR FOOD COOKING APPLIANCES

(75) Inventor: Tiziano Lacche, Matelica (IT)

(73) Assignee: Indesit Company S.p.A., Fabriano (IT)

( * ) Notice: Subject to any disclaimer, the term of this patent is extended or adjusted under 35 U.S.C. 154(b) by 1259 days.

(21) Appl. No.: 12/528,371

(22) PCT Filed: Feb. 14, 2008

(86) PCT No.: PCT/IB2008/000329

§ 371 (c)(1),
(2), (4) Date: Aug. 24, 2009

(87) PCT Pub. No.: WO2008/104845

PCT Pub. Date: Sep. 4, 2008

(65) Prior Publication Data

US 2010/0319677 A1 Dec. 23, 2010

(30) Foreign Application Priority Data

Feb. 26, 2007 (IT) ..... TO2007A0133

(51) Int. Cl.
*F23D 14/04* (2006.01)
*F23D 14/64* (2006.01)
*F24C 3/08* (2006.01)

(52) U.S. Cl.
USPC ..... 126/39 E; 126/39 R; 126/1 R; 431/110

(58) Field of Classification Search
CPC ..... F23D 14/085; F23D 14/02; F24C 3/082; F24C 3/085
USPC ..... 126/39 E; 431/110
IPC ..... F23D 14/06,14/04, 14/10, 14/64, 13/40; F24C 3/08
See application file for complete search history.

(56) References Cited

U.S. PATENT DOCUMENTS

| | | | | |
|---|---|---|---|---|
| 3,858,811 | A | 1/1975 | Mizerak et al. | |
| 5,277,576 | A * | 1/1994 | Hartung et al. | 431/198 |
| 5,401,164 | A * | 3/1995 | Yen | 431/354 |
| 6,325,619 | B2 * | 12/2001 | Dane | 431/284 |
| 6,332,460 | B1 * | 12/2001 | Paesani | 126/39 R |
| 6,780,008 | B2 * | 8/2004 | Koch et al. | 431/354 |
| 7,594,812 | B2 * | 9/2009 | Armanni | 431/283 |
| 7,661,954 | B2 * | 2/2010 | Harneit | 431/278 |

(Continued)

FOREIGN PATENT DOCUMENTS

| | | |
|---|---|---|
| AU | 412372 B2 | 4/1971 |
| BE | 547098 | 12/1959 |

(Continued)

*Primary Examiner* — Kang Hu
*Assistant Examiner* — Daniel E Namay
(74) *Attorney, Agent, or Firm* — Cesari and McKenna, LLP

(57) ABSTRACT

A gas burner system for food cooking appliances is provided. The system includes a gas supplying duct for delivery of gas to burner system. A first sump and a second sump are coupled to the duct through a pair of nozzles, such that the first and second sumps mix primary air with gas delivered by the duct. A pair of Venturi effect chambers are connected to the first sump and second sump respectively, and are inclined towards a pair of concentric burner components that include an outer burner component and an inner burner component. The Venturi effect chambers direct the air-gas mixture to the inner and outer burner components. Caps are provided over the first and second burner components.

20 Claims, 2 Drawing Sheets

(56) References Cited

U.S. PATENT DOCUMENTS

| | | | | |
|---|---|---|---|---|
| 7,901,205 | B2 * | 3/2011 | Trochou | 431/284 |
| 2001/0010897 | A1 * | 8/2001 | Dane | 431/266 |
| 2003/0228550 | A1 * | 12/2003 | Koch et al. | 431/195 |
| 2005/0277079 | A1 | 12/2005 | Wu | |
| 2007/0141521 | A1 * | 6/2007 | Armanni | 431/354 |
| 2007/0218414 | A1 * | 9/2007 | Harneit | 431/354 |
| 2008/0206697 | A1 * | 8/2008 | Trochou | 431/284 |
| 2009/0047611 | A1 * | 2/2009 | Armanni | 431/284 |
| 2010/0279238 | A1 * | 11/2010 | Harneit | 431/144 |
| 2010/0319677 | A1 * | 12/2010 | Lacche | 126/39 E |

FOREIGN PATENT DOCUMENTS

| | | | | | |
|---|---|---|---|---|---|
| DE | 392522 | | | 3/1924 | |
| DE | 3918722 | | | 11/1990 | |
| DE | 10315343 | A1 | | 10/2004 | |
| EP | 0485645 | | | 5/1992 | |
| EP | 0552135 | A | | 7/1993 | |
| EP | 1120603 | A2 | * | 8/2001 | F23D 14/06 |
| EP | 1132685 | | | 9/2001 | |
| EP | 1531304 | A | | 5/2005 | |
| EP | 2236921 | A1 | * | 10/2010 | F23D 14/06 |
| FR | 432193 | | | 11/1911 | |
| FR | 2404803 | | | 4/1979 | |
| FR | 2414681 | | | 8/1979 | |
| GB | 2223302 | | | 4/1990 | |
| GB | 2233444 | A | | 1/1991 | |
| GB | 2280743 | | | 2/1995 | |
| JP | 61 086507 | | | 5/1986 | |
| JP | 2002317935 | A | * | 10/2002 | F24C 3/08 |
| JP | 2002333108 | A | * | 11/2002 | F23D 14/06 |
| JP | 2002333109 | A | * | 11/2002 | F23D 14/06 |
| JP | 2003090518 | A | * | 3/2003 | F23D 14/74 |
| JP | 2005156087 | A | * | 6/2005 | F23D 14/06 |
| WO | WO 2005/078342 | | | 8/2005 | |
| WO | WO 2006051368 | A1 | * | 5/2006 | |
| WO | WO 2007/012766 | | | 2/2007 | |
| WO | WO 2008/104831 | | | 9/2008 | |
| WO | WO 2008104845 | A2 | * | 9/2008 | F23D 14/06 |

* cited by examiner

GAS BURNER SYSTEM FOR FOOD COOKING APPLIANCES

The present invention relates to a gas burner system for food cooking appliances according to the preamble of claim 1.

Burner systems are known in the art which comprise two concentric burners, generally an outer one and an inner one, having a substantially circular shape.

Burner systems of the double burner type are also known which comprise two concentric burners that may be fed by independent control valves, so that the two burners can be used either together or separately in order to achieve good variability and a homogeneous distribution of the heat to be transferred to the cooking containers. As an alternative, both concentric burners may be fed by a single gas inlet duct, fitted with an associated tap, which simultaneously feeds the different intake channels supplying the air-gas mixture to the burners.

In addition, in the burner systems known in the art the gas may be mixed with primary air either above or below the cooking top on which the burner system is mounted.

For example, Italian patent No. IT 1232887 in the name of the same Applicant describes a gas burner system comprising two concentric burners wherein gas is mixed with primary air above the cooking top on which the burner system is mounted and through ducts operating as a Venturi tube. In order to ensure a uniform outlet of the air-gas mixture through the holes or vents of an outer burner of said concentric burners, wedge-shaped profiles are obtained on the underside of the caps covering the outer burner; however, such wedge-shaped profiles imply the drawback of requiring caps having a complex construction as well as an excessive and undesired height.

International patent application No. WO 2005/078342 describes a gas burner system for food cooking applications comprising a main body inside of which two distinct, non-communicating gas inlet ducts are obtained. Said inlet ducts reach the centre of the main body for feeding a central burner and an outer burner concentric to the central burner in an independent manner; in particular, a first nozzle for feeding the central burner branches off a first inlet duct, whereas a diverging pair of nozzles for feeding the outer burner branches off a second inlet duct. In addition, said gas burner system comprises three Venturi effect chambers: a first central chamber having a vertical axis, located above the first nozzle, and two other chambers having an inclined and diverging axis, located above the diverging pair of nozzles.

This solution suffers from several problems and drawbacks as well.

In particular, the fact that the burner feeding nozzles are central with respect to the main body of the gas burner system implies much difficulty in mixing primary air with gas. As a matter of fact, primary air must follow a winding path among the various components of the burner system, so that its gas mixing efficiency is inevitably reduced.

A further drawback of the above-described system is that the inclined and diverging axis of the nozzles and of the associated Venturi effect chambers causes much difficulty in directing the flames of the burner system upwards, i.e. towards the cooking containers. In particular, when using cooking containers having a spherical bowl-shaped bottom, the above-described burner system even require that the caps be replaced with other components having an appropriate profile. Therefore, such a solution also suffers from the drawback of requiring the use of a large number of components adapted to make up the entire burner system in order to ensure an adequate heating of different cooking containers; this complexity inevitably translates into higher costs.

Another drawback of said gas burner system is that the first central Venturi effect chamber having a vertical axis does not allow to limit the height of the central burner, and therefore of the gas burner system as a whole.

In this frame, it is the main object of the present invention to overcome the above-mentioned drawbacks.

In particular, it is the main object of the present invention to provide an improved gas burner system for food cooking appliances which allows to optimize the combustion efficiency of the burner system, thus making it more effective than the solutions of the prior art.

It is another object of the present invention to provide a gas burner system for food cooking appliances which facilitates the mixing of primary air with gas.

It is another object of the present invention to provide a gas burner system for food cooking appliances wherein the flames of the burner system can easily be directed upwards, in particular towards the cooking containers, without the need of using a large number of components adapted to make up the complete burner system in order to heat different cooking containers appropriately, thus also remarkably cutting down the costs of the gas burner system as a whole.

It is a further object of the present invention to provide a solution which allows to limit the height of the complete gas burner system for food cooking appliances.

In order to achieve such objects, the present invention provides a gas burner system for food cooking appliances incorporating the features set out in the appended claims, which are intended as an integral part of the present description.

Further objects, features and advantages of the present invention will become apparent from the following detailed description and from the annexed drawings, which are supplied by way of non-limiting example, wherein.

Figure 1:
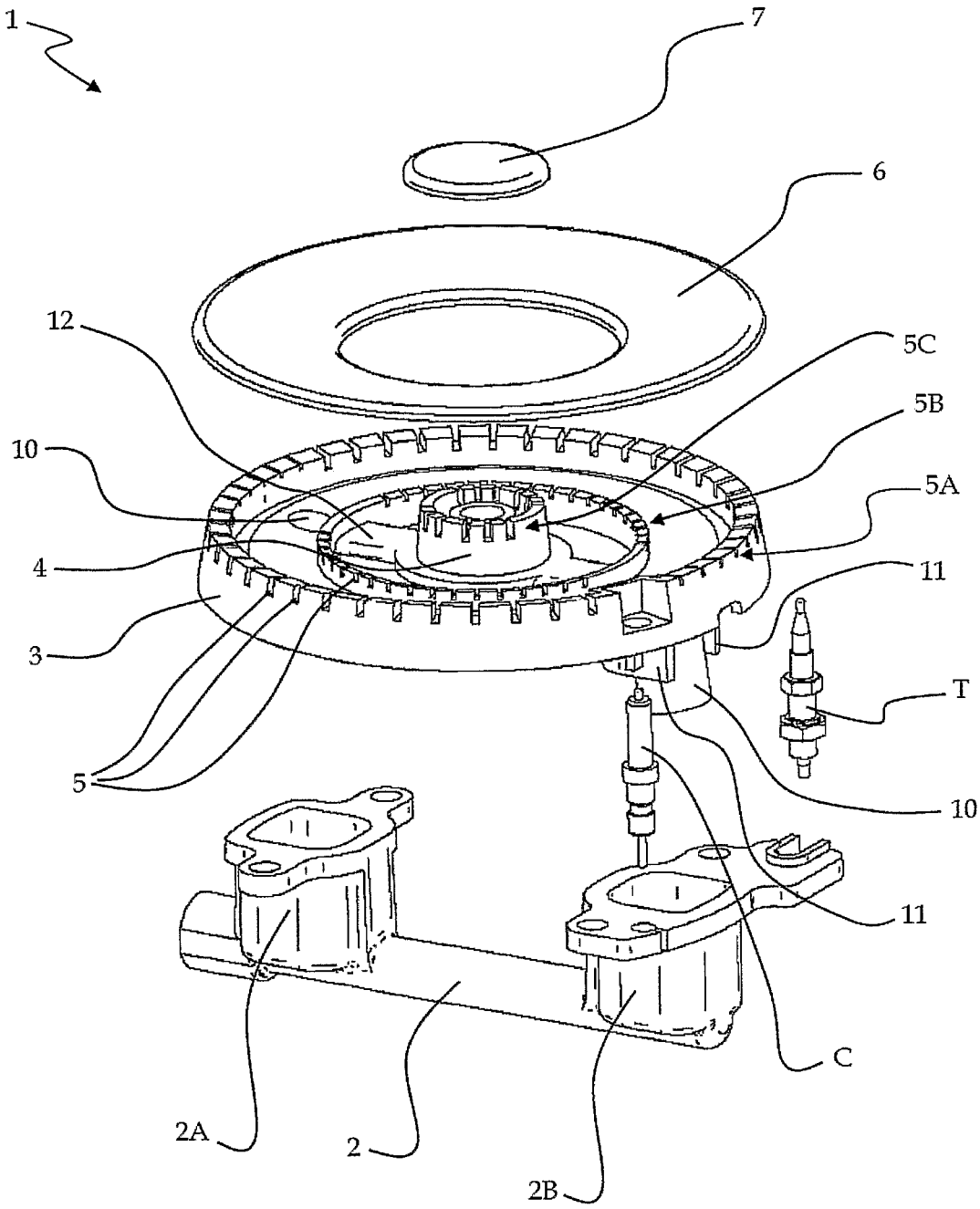
FIG. 1 is an exploded view of a gas burner system for food cooking appliances according to the present invention.

Referring now to FIG. 1, which is an exploded view of a gas burner system for food cooking appliances according to the present invention, reference number 1 designates the gas burner system as a whole, which comprises a duct 2 for supplying gas to said burner system 1. Said duct 2 comprises a first sump 2A and a second sump 2B.

Burner system 1 also comprises a pair of substantially concentric burners 3, 4, said pair of burners 3, 4 comprising an outer burner 3 and an inner burner 4.

According to the embodiment of FIG. 1, in the proximity of said second sump 2B there are an ignition spark plug C and a thermocouple T; in particular, ignition spark plug C and thermocouple T are associated with outer burner 4. It is clear, however, that ignition spark plug C and/or thermocouple T may be coupled to other components of burner system 1 according to the present invention (in particular, they may advantageously be arranged within inner burner 3, near second crown 5B).

On the outer perimeter of their upper edge, said outer burner 3 and inner burner 4 have main vents 5 for letting out and igniting the primary air-gas mixture suitable for heating a cooking container (not shown).

Burner system 1 shown in FIG. 1 is of the triple crown type, since the drawing clearly shows that:

- outer burner 3 comprises a double crown 5A, 5B of main vents 5, a first crown 5A of main vents 5 being adapted to direct the flame outwards, away from burner system 1, and a second crown 5B of main vents 5 being adapted to direct the flame towards inner burner 4;

inner burner 4 comprises a third crown 5C of main vents 5.

It is however clear that different arrangements of burner system 1 according to the present invention are possible as well. For example, inner burner 4 may also comprise a double crown of main vents 5 (not shown in the drawings), thus obtaining a quadruple flame crown burner system 1.

Burner system 1 may also comprise secondary vents, smaller than main vents 5 and preferably arranged each between two main vents 5, which ensure flame propagation and stabilization, in particular as outer burner 3 and inner burner 4 are being ignited.

A first cap 6 is positioned on outer burner 3, while a second cap 7 is positioned on inner burner 4, the shape and dimensions of said caps 6 and 7 essentially matching those of said outer burner 3 and inner burner 4. Aiming at reducing the number of parts making up burner system 1 according to the present invention, first cap 6 is preferably provided in one piece adapted to be laid on outer burner 3. In particular, said caps 6 and 7 are symmetrical relative to a central axis A (visible in FIG. 2) of said burner system 1, the first cap 6 having a toroidal shape and second cap 7 having a discoidal shape.

Figure 2:
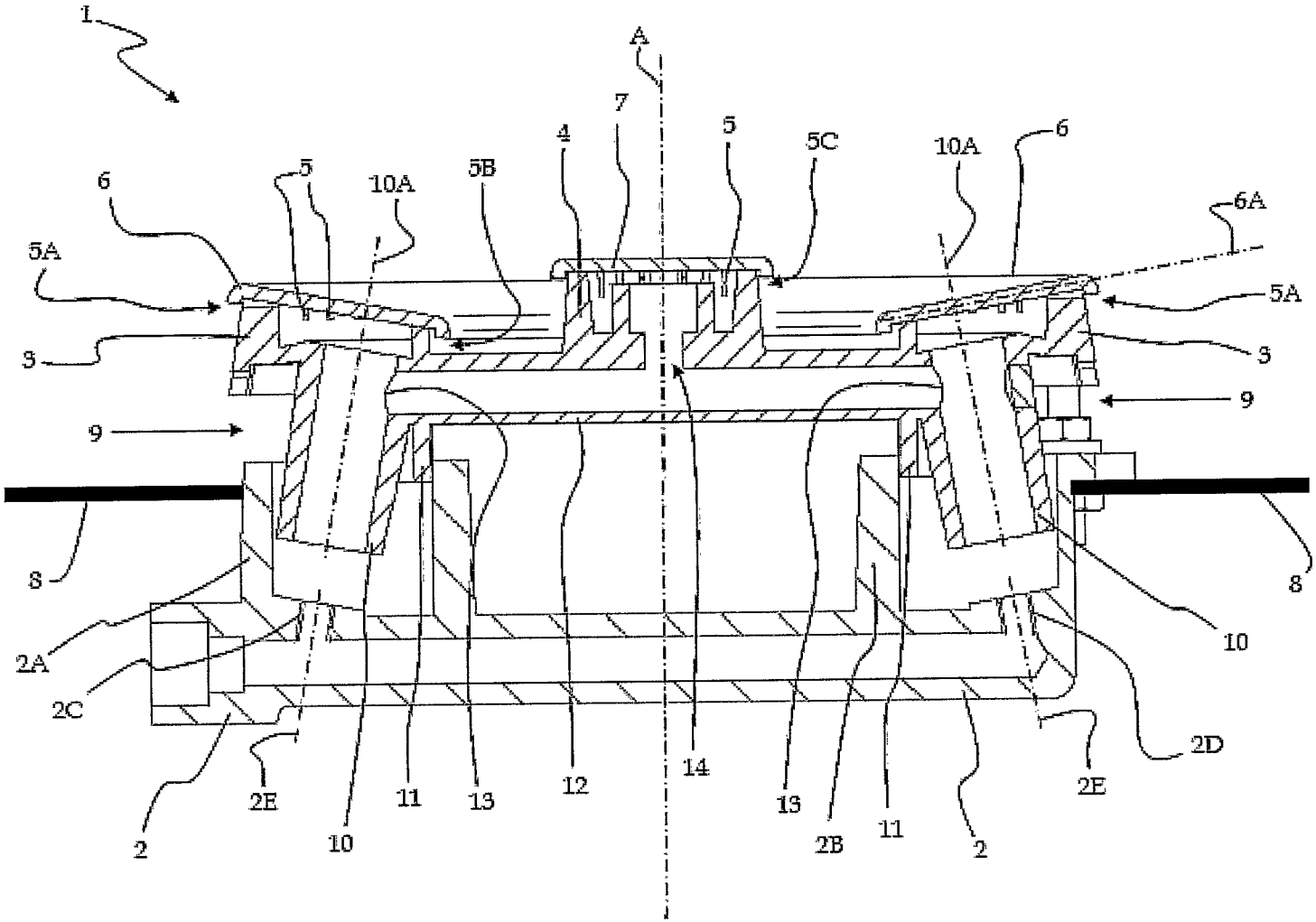
FIG. 2 is a sectional view of the gas burner system according to the present invention.

As shown in particular in FIG. 1 and FIG. 2, in burner system 1 according to the present invention primary air is taken from above a cooking top 8 on which said burner system 1 is mounted. In particular, primary air is taken in through passages 9 obtained on a lateral surface of outer burner 3 and located on opposite sides with respect to central axis A of said burner system 1. Moreover, first sump 2A and second sump 2B are connected to duct 2 through at least one pair of nozzles, in particular a first nozzle 2C and a second nozzle 2D. Consequently, said primary air is mixed with gas delivered by duct 2 within first sump 2A and second sump 2B.

Taking primary air from above cooking top 8 allows to avoid some problems which are often encountered in all those cases where primary air is taken from below a cooking top. Such problems may be caused by air flow disturbance, e.g. when opening or closing cabinet doors underneath burner system 1, or by primary air pollution due to the presence of a cooking oven underneath said burner system 1.

In accordance with the present invention, burner system 1 comprises a pair of Venturi effect chambers 10 having a first axis 10A inclined towards central axis A of said burner system 1, said pair of Venturi effect chambers 10 being obtained on the underside of outer burner 3. The angle of inclination of said first axis 10A relative to central axis A of burner system 1 is between 5° and 25°, preferably between 12° and 14°. Said pair of chambers 10 is adapted to direct the air-gas mixture flow coming from first sump 2A and from second sump 2B towards vents 5 of burners 3 and 4. Said inclination of said pair of Venturi effect chambers 10 allows to improve the combustion efficiency of burner system 1 according to the present invention considerably, thus making burner system 1 more efficient and powerful, the quantity of consumed gas being equal.

In FIG. 2 it can be seen that said chambers 10 are located on diametrically opposed sides with respect to axis A of burner system 1; in particular, said chambers 10 are located in the regions of the primary air intake passages 9.

Such a positioning of chambers 10 allows to obtain an adequate mixing of primary air with the gas delivered by duct 2, and allows to optimize, without adversely affecting it, the flow of secondary air required for the proper operation of crowns 5A, 5B, 5C of main vents 5, in particular of second crown 5B and third crown 5C.

In a preferred embodiment of burner system 1 according to the present invention, said pair of nozzles 2C, 2D comprise a second axis 2E inclined towards central axis A of said burner system 1. In particular, said second axis 2E substantially coincides with first axis 10A of the pair of Venturi effect chambers 10.

As a consequence, the fact that the pair of nozzles 2C, 2D have the same angle of inclination as chambers 10 allows to improve even further the combustion efficiency of burner system 1 according to the present invention and thus, the power output of burner system 1 being equal, to reduce gas consumption.

Burner system 1 according to the present invention comprises dividing walls 11 provided on the underside of outer burner 3, for the purpose of closing primary air intake passages 9 and directing said primary air towards first sump 2A and second sump 2B. Consequently, said dividing walls 11 allow to improve the flow of primary air within first sump 2A and second sump 2B, as well as to separate the primary air flow from the secondary air flow appropriately.

Furthermore, the provision of dividing walls 11 on the underside of outer burner 3 is particularly advantageous because said dividing walls 11 can be obtained together with the other components of outer burner 3, in particular during the die casting process carried out in order to manufacture the latter.

By providing dividing walls 11 on the underside of outer burner 3, rather than on duct 2 or on first sump 2A and second sump 2B, it is also possible to:

simplify the production cycle of burner system 1, limit the size of said sumps 2A and 2B, thus saving a large amount of material, simplify the cleaning of burner system 1, which is particularly useful since sumps 2A and 2B are secured to cooking top 8 and are difficult to clean.

As shown in FIG. 2, first cap 6 extends along a third axis 6A which is substantially perpendicular to first axis 10A of said chambers 10. This inclination of first cap 6 allows the air-gas mixture flow coming from Venturi effect chambers 10 to be optimally directed towards vents 5 of both first crown 5A and second crown 5B. In addition, said inclination of cap 6 allows vents 5 of second crown 5B (which direct the flame towards inner burner 4) to be kept at an optimal distance from vents 5 of inner burner 4; as a result, said inclination allows both outer burner 3 and inner burner 4 to operate properly, while at the same time limiting the height of inner burner 4 and of entire burner system 1 according to the present invention.

Venturi effect chambers 10 and inner burner 4 are connected together through a duct 12 extending under said inner burner 4.

In particular, a pair of passages 13 allow said duct 12 to be hydraulically connected to respective chambers 10, whereas a vent 14 allows duct 12 to be hydraulically connected to inner burner 4.

Therefore, duct 12 allows to canalize the primary air-gas mixture flowing in chambers 10 and to convey it towards inner burner 4, so that it can flow out through the vents 5 of third crown 5C.

As a consequence, it is apparent that in burner system 1 according to the present invention two concentric burners 3, 4 can both be fed by gas inlet duct 2 alone, which simultaneously feeds the different intake channels that supply air-gas mixture to burners 3, 4.

The features of the present invention, as well as its advantages, are apparent from the above description.

In particular, the fact that first axis 10A of the pair of Venturi effect chambers 10 is inclined towards central axis A of burner system 1 provides a considerable improvement in the combustion efficiency of said burner system 1, thus making the latter more efficient and powerful, the quantity of consumed gas being equal.

A further advantage of gas burner system 1 for food cooking appliances according to the present invention is offered by the arrangement of chambers 10 on diametrically opposed sides with respect to axis A of burner system 1 in the regions of primary air intake passages 9, which ensures that primary air is mixed appropriately with the gas delivered by duct 2. Thus, the secondary air flow required for the operation of second crown 5B and third crown 5C of main vents 5 is not affected at all. It should also be pointed out that the present invention provides a first sump 2A/second sump 2B assembly having very small dimensions, which translates into a remarkable material saving.

The fact that the pair of nozzles 2C, 2D comprise a second axis 2E inclined towards the central axis A of said burner system 1, in particular that said second axis 2E has the same angle of inclination as chambers 10, allows to improve the combustion efficiency of burner system 1 even further, thus reducing gas consumption while obtaining the same power output.

Another advantage of burner system 1 according to the present invention is that the presence of dividing walls 11 allows to improve the flow of primary air within first sump 2A and second sump 2B, as well as to separate the primary air flow from the secondary air flow appropriately.

In addition, the fact that said dividing walls 11 are obtained on the underside of outer burner 3 allows to simplify the production cycle of burner system 1, thus reducing the quantity of material required for manufacturing sumps 2A, 2B and making sumps 2A, 2B easier to clean.

Another advantage of burner system 1 according to the present invention is that cap 6 having a third axis 6A substantially perpendicular to first axis 10A of said chambers 10 allows the air-gas mixture flow to be directed in the most appropriate manner towards first crown 5A and second crown 5B.

Furthermore, the particular inclination of chambers 10 and of first cap 6 allows to limit the height of inner burner 4 and thus of burner system 1 as a whole, in that vents 5 of second crown 5B can remain at an appropriate distance from vents 5 of inner burner 4.

The burner system described herein by way of example may be subject to many possible variations without departing from the novelty spirit of the inventive idea; it is also clear that in the practical implementation of the invention the illustrated details may have different shapes or be replaced with other technically equivalent elements.

Among the various possible modifications, second cap 7 may be provided with its underside inclined upwards in its distal development, i.e. in the direction extending outwards from axis A of burner system 1.

According to another possible modification, first cap 6 may be made up of two or more parts suitable for being laid on outer burner 3.

It can therefore be easily understood that the present invention is not limited to the above-described device, but may be subject to many modifications, improvements or replacements of equivalent parts and elements without departing from the inventive idea, as clearly specified in the following claims.

Furthermore, the teaching of the present invention is also applicable to a simple gas burner such as, for example, outer burner 3 shown in the drawings, by eliminating inner burner 4, second cap 7 and duct 12, with all of associated passages 13 and vents 14.

In conclusion, the present invention also relates to a gas cooking top for food cooking applications comprising at least one burner and/or one burner system having one or more of the above-described features.

The invention claimed is:

1. A gas burner system for food cooking appliances, the gas burner system comprising:

at least one gas burner disposed on a cooktop;

a first gas supplying duct connected to an associated source of gas, the first gas supplying duct including a first sump and a second sump, each of said first sump and said second sump being coupled to said gas supplying duct through at least one nozzle, and gas supplied to said first gas supplying duct is mixed in said first sump and said second sump with primary air flowing from above said cooktop;

the at least one gas burner including:

an outer burner component and an inner burner component, each being concentric with a central axis;

a first Venturi effect chamber leading from said first sump to said outer burner component and a second Venturi effect chamber leading from said second sump to said outer burner component, said first Venturi effect chamber and said second Venturi effect chamber each having a first axis wherein a top portion of the first axis is inclined towards said central axis of the gas burner relative to a bottom portion of the first axis, such that said first Venturi effect chamber and said second Venturi effect chamber direct an air-gas mixture to the outer burner component; and a vent extending between said first Venturi effect chamber, said second Venturi effect chamber, and said inner burner component such that the air-gas mixture is directed to the inner burner component.

2. The gas burner system as defined in claim 1 wherein said first Venturi effect chamber and said second Venturi effect chamber are disposed on an underside of the outer burner component.

3. The gas burner system as defined in claim 2 wherein said first Venturi effect chamber and said second Venturi chamber are located on diametrically opposed sides of said at least one gas burner with respect to said central axis.

4. The gas burner system as defined in claim 1 wherein an angle of inclination of each said first axis relative to said central axis of the gas burner system is between about 5° and 25°, and preferably between about 12° and 14°.

5. The gas burner system as defined in claim 1 further comprising: one or more primary air intake passages disposed proximate to the outer burner component.

6. The gas burner system as defined in claim 5 further comprising:

two primary air intake passages arranged on opposite sides with respect to said central axis.

7. The gas burner system as defined in claim 6 wherein said first Venturi effect chamber and said second Venturi chamber are located in regions proximate to said primary air intake passages.

8. The gas burner system as defined in claim 7 further comprising:

at least one dividing wall provided on at least a portion of an underside of the outer burner component to improve the flow of air within the first sump and the second sump.

9. The gas burner system as defined in claim 1 further comprising:

a triple crown configuration arranged to deliver flames for cooking on the at least one gas burner, the triple crown configuration including: a double crown of main vents for the formation of flames on the outer burner component, a first crown being adapted to direct the flames outwardly, away from the gas burner system, a second crown being adapted to direct the flame towards the inner burner component, and a third crown of main vents disposed on the inner burner component.

10. The gas burner system as defined in claim 1 further comprising:

a pair of nozzles leading from the associated source of gas, a first nozzle inclined along said first axis of said first Venturi effect chamber and a second nozzle inclined along said first axis of said second Venturi effect chamber such that each nozzle delivers gas to respective Venturi effect chambers along the same axis of the respective Venturi effect chambers.

11. The gas burner system as defined in claim 1, further comprising a first cap comprising a single piece ring-shaped component adapted to cover an upper surface of said outer burner component along an outer circumference of said outer burner component, and a second cap adapted to cover an upper surface of said inner burner component.

12. The gas burner system as defined in claim 11 wherein the first cap has a generally toroidal shape and the second cap has a generally discoidal shape.

13. The gas burner system as defined in claim 12 wherein said first cap extends along a different axis which is substantially perpendicular to the first axis of said first Venturi effect chamber.

14. The gas burner system as defined in claim 1 wherein said first Venturi effect chamber and second Venturi effect chamber are connected together through a conduit extending under said inner burner component.

15. The gas burner system as defined in claim 14 further comprising a pair of passages which allow said conduit to be hydraulically connected to said first Venturi effect chamber and said second Venturi effect chamber and a vent which allows the duct to be hydraulically connected to the inner burner component.

16. A gas burner for food cooking appliances, comprising:

a gas supply duct;

a first sump and a second sump being connected to said gas supply duct through at least one pair of nozzles, the gas supplied to the gas burner being mixed in said first sump and said second sump with primary air taken in from above a cooking top on which the gas burner is mounted in order to create an air-gas mixture; and a first Venturi effect chamber and a second Venturi effect chamber each having a first axis, wherein a top portion of the first axis is inclined towards a central axis of said gas burner relative to a bottom portion of the first axis, where said first Venturi effect chamber and said second Venturi effect chamber are disposed on an underside of the gas burner, said first Venturi effect chamber and said second Venturi effect chamber chamber being arranged on diametrically opposed sides with respect to the central axis of the gas burner, such that said first Venturi effect chamber and said second Venturi effect chamber direct the air-gas mixture to an outer burner component and an inner burner component.

17. The gas burner as defined in claim 16 wherein said first sump and said second sump are connected to said gas supply duct through the at least one pair of nozzles such that each nozzle is arranged with a central axis, being a second axis, which essentially coincides with said first axis of the first Venturi effect chamber and said second Venturi effect chamber.

18. The gas burner as defined in claim 16 further comprising:

air intake passages disposed on the outer burner component and arranged on opposite sides with respect to said central axis to receive primary air laterally into said gas burner.

19. The gas burner as defined in claim 18 further comprising:

dividing walls provided on the underside of the gas burner for improving the flow of air into said first and second sump.

20. The gas burner system as defined in claim 1 wherein the top portion of the first axis of the first Venturi effect chamber and the first axis of the second Venturi effect chamber are inclined towards each other.

* * * * *

UNITED STATES PATENT AND TRADEMARK OFFICE

CERTIFICATE OF CORRECTION

PATENT NO. : 8,746,229 B2
APPLICATION NO. : 12/528371
DATED : June 10, 2014
INVENTOR(S) : Tiziano Lacche It is certified that error appears in the above-identified patent and that said Letters Patent is hereby corrected as shown below:

In the Claims:
Claim 3, col. 6, line 45 should read:
first Venturi effect chamber and said second Venturi effect chamber Claim 7, col. 6, line 60 should read:
first Venturi effect chamber and said second Venturi effect chamber Signed and Sealed this
Eleventh Day of November, 2014

Michelle K. Lee

Michelle K. Lee
*Deputy Director of the United States Patent and Trademark Office*